US007901157B2

(12) United States Patent
Jeffrey

(10) Patent No.: US 7,901,157 B2
(45) Date of Patent: Mar. 8, 2011

(54) VIBRATORY PLATE COMPACTOR WITH AGGREGATE FEED SYSTEM

(76) Inventor: Dean Jeffrey, Peterborough (CA)

( * ) Notice: Subject to any disclaimer, the term of this patent is extended or adjusted under 35 U.S.C. 154(b) by 295 days.

(21) Appl. No.: 12/227,494

(22) PCT Filed: Apr. 18, 2007

(86) PCT No.: PCT/CA2007/000624

§ 371 (c)(1),
(2), (4) Date: Nov. 19, 2008

(87) PCT Pub. No.: WO2007/118316

PCT Pub. Date: Oct. 25, 2007

(65) Prior Publication Data

US 2009/0175682 A1 Jul. 9, 2009

(30) Foreign Application Priority Data

Apr. 18, 2006 (CA) ..... 2543766

(51) Int. Cl.
*E01C 19/30* (2006.01)

(52) U.S. Cl. ..... 404/102; 404/133.05

(58) Field of Classification Search ..... 404/102, 404/133.05, 133.1, 133.2
See application file for complete search history.

(56) References Cited

U.S. PATENT DOCUMENTS 3,336,848 A * 8/1967 Moir ..... 404/114
4,005,944 A * 2/1977 Harris ..... 404/133.2
5,735,634 A * 4/1998 Ulrich et al. ..... 404/102

* cited by examiner

*Primary Examiner* — Gary S Hartmann

(57) ABSTRACT

A vibratory plate compactor with aggregate feed system includes a frame, a soil compacting plate and a drive mechanism, such as a hydraulic motor, is mounted on the frame and has a rotatable drive shaft which uses a V-belt to drive a vibratory actuator on the tamping plate. The frame also carries a hopper that uses a screw conveyor to force the stored aggregate into a vertical conduit. A tamping piston forces aggregate out of the vertical conduit, through apertures in the compactor plate and compacts the loose soil with a multitude of blows, the vibratory plate is then actuated to further compact the aggregate. The process is repeated until the cavity is filled and compacted to the required density. The vibratory plate compactor with aggregate feed system is ideally suited to filling and compacting aggregate in used automobile tires that are used in the formation of a tire wall.

6 Claims, 6 Drawing Sheets

VIBRATORY PLATE COMPACTOR WITH AGGREGATE FEED SYSTEM

This invention provides a vibratory plate compactor with aggregate feed system, more particularly of the portable type for dispensing and compacting aggregate materials into cavities such as used automobile tires for the purpose of building walls. The invention can also be used to supply make-up aggregate when tamping uneven ground or filling potholes. The tires may also be filled, compacted and then placed on a sea floor to assist in the formation of a reef or underwater structure.

BACKGROUND OF THE INVENTION

Tires that have been filled with aggregate and compacted have long been used as building blocks in the construction of retaining walls and housing. The vibratory plate compactor with aggregate feed system is best suited to filling and compacting aggregate into cavities such as used automobile tires so the tires may be used as bricks in the formation of a tire wall.

Vibratory plate compactors have long been known and widely used. Vibratory plate compactors usually include a gas engine driving a shaft that is eccentrically weighted. Typical vibratory plate compactors of this type are shown in the following U.S. Pat. Nos.:

3,232,188 Frohnauer
3,336,848 Moir
3,603,224 Dresher
4,771,645 Perrson

Powered soil aggregate auger conveyors are widely used for dispensing soil aggregates. Though such vibratory plate compactors and aggregate auger conveyors have achieved considerable popularity and commercial success, there has been a continuing need for the combination of the devices to create a vibratory plate compactor with an aggregate auger conveyor feed system.

SUMMARY OF THE INVENTION

The invention of a vibratory plate compactor with aggregate feed system includes a frame which is supported by rubber mounts connected to a sub-frame that has a soil compacting plate. A drive mechanism such as a high-speed hydraulic motor is mounted on the main frame and has a rotatable drive shaft. A vibratory unit consisting of an eccentrically weighted shaft is mounted for rotation on the sub-frame and is connected to the output shaft or flywheel of the frame mounted high-speed hydraulic motor by suitable flexible transmission means such as sheaves and V-belts or chain and sprocket means.

The frame also carries a hopper compartment for transporting and dispensing aggregate materials. A hydraulic motor drives an auger conveyor which is located in an auger conduit that is below and open to the hopper compartment for dispensing aggregate materials therefrom. The auger conduit is connected to an aggregate reservoir which is connected and open to a vertical conduit. A motor driven tamping piston operates within the vertical conduit and it forces any aggregate out of the vertical conduit and through the plate conduit of the sub-frame. The plate conduit divides into four smaller outwardly angled conduits. The vibratory tamping plate of the sub-frame is sized to fit inside the rim of the tire. A vibration isolated wheel rim surrounds the tamping plate and is attached to the frame by rubber mounts.

In operation, the present invention is directed towards a method of filling and compacting soil aggregate in a cavity such as a used automobile tire for the purpose of using the filled tire as a building block in the construction of a tire wall. First, an area is excavated and then a row of tires are laid down on their sides to form the foundation of the tire wall. A piece of cardboard is inserted in the bottom of each tire in order to stop aggregate from flowing out the hole in the bottom of the tire. The machine is placed on the first tire with the wheel rim seated firmly on the bead structure of the tire. The changeable wheel rim and sub-frame are sized to fit the tire the machine is working on. The wheel rim acts as guide to line-up the tamping plate with the tire by placing the wheel rim directly on the bead structure of the tire. The wheel rim prevents the tamping plate from coming into contact with the tire and it is mounted to the frame with rubber mounts which reduces the vibrational forces that could cause the sidewall of the tire to vibrate and eject aggregate from the cavity.

Aggregate is shovelled into the hopper of the vibratory plate compactor with aggregate feed system. The control valves are used to simultaneously actuate the auger motor and tamping piston motor. The auger transports aggregate material from the hopper, through the auger conduit, the aggregate reservoir and into the vertical conduit. During the low end of the tamping piston's stroke, the aperture is blocked by the sidewall of the tamping piston and aggregate fills the aggregate reservoir. When the tamping piston is at the upper end of its stroke, the aperture between the aggregate reservoir and the vertical conduit is not blocked by the elongated tamping piston and aggregate is forced into the vertical conduit. The tamping plate conduit divides the flow of aggregate into four smaller flows and directs the aggregate outwards towards the inner liner of the tire.

Actuating the tamping piston motor turns a crankshaft by a chain and sprocket means. The rotating crankshaft drives a piston in a vertical motion, which forces the piston drive arm up and down. The tamping piston drive arm is connected at its forward end to the drive arm mounts by means of a pivot with the opposite end moving through a large arc. Attached to the rearward end of the tamping piston drive arm is the tamping piston.

The tamping piston moves in an up and down motion within the vertical conduit and the face of the tamping piston acts to compact and discharge the aggregate out of the lower aperture of the vertical conduit. During the lowest point of the stroke of the tamping piston, the soil contacting face of tamping piston extends beyond the plane of the lower aperture of the vertical conduit and enters the upper portion of the plate conduit. The tamping piston forces aggregate through the plate conduit to the underside of the tamping plate. The auger and tamping piston motors are stopped and the tamping plate motor is actuated.

The tamping plate motor drives the vibratory actuator unit on the subframe the aggregate is further compacted beneath surface of the tamping plate with a multitude of blows, which together with the mass of the assembly supported on the tamping plate in effect produces at least a ramming compacting action under the plate and the rapidity of the blows imparted to the material further has the effect of shaking and vibrating not only the space immediately underneath the contacted surface but also in the space adjacent laterally and in depth, tending to settle loose particles by the very shaking itself. The angled tamping plates and angle of the outlet conduits further increases the lateral compaction.

To ensure an even supply of aggregate and even compaction of aggregate, the machine operator can rotate the machine by moving the handle up to 30 degrees to the left or right of the operator's standing position which rotates the machine while the wheel rim remains in contact with the bead structure. Actuating the plate tamper while rotating the machine makes moving the machine easier because the jumping action of the machine when the tamping plate is actuated eases the surface friction between the wheel rim and the tire bead, as well as the tamping plate surface and the aggregate it is in contact with. The compaction of aggregate creates a space and more aggregate is added by repeating the process of actuating the auger conveyor and tamping piston and then the plate tamper.

Once the tire has been filled and the aggregate compacted to the desired density, the machine may then be lifted by using a winch connected to the machine's lifting eye and moved to the next tire in the row. The remaining cavity in the tire, which is the shape of the tamping plate, is then filled by shovelling aggregate into the space and the material is compacted with a hand tamping plate. The rows of tires are offset in a manner similar to brick wall construction and off-setting each row back towards the embankment can give greater support to the structure. The process is repeated until the tire wall is complete.

Other objects and advantages will appear from the following description and figures, which form a part of this specification;

DETAILED DESCRIPTION OF THE INVENTION

Figure 1:
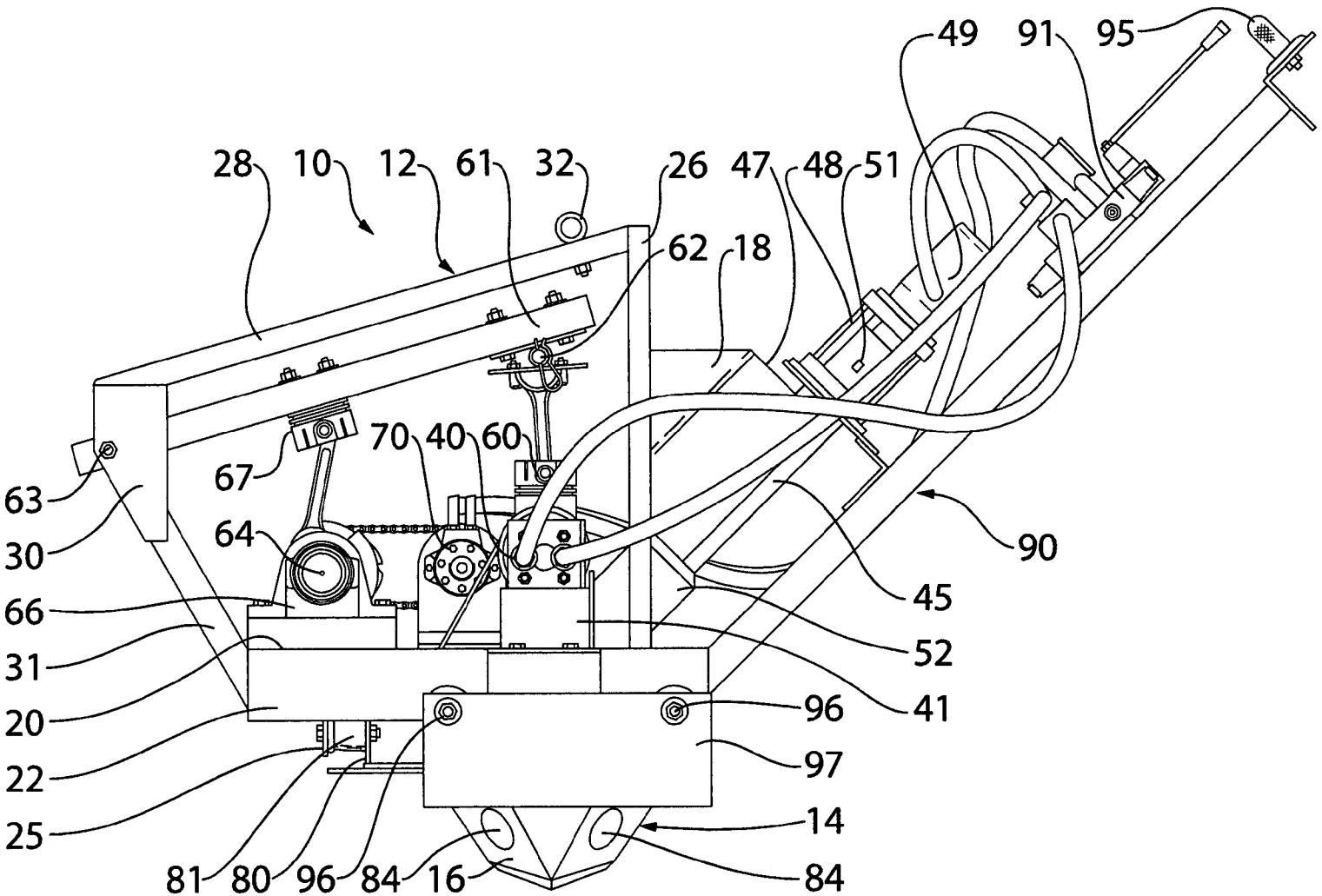
FIG. 1 is a side view of a vibratory plate compactor with aggregate feed system embodying the subject invention.

In the particularly advantageous embodiment of the invention illustrated in FIG. 1, a vibratory plate compactor with aggregate feed system 10 for filling a cavity is for example, a used automobile tire, and increasing the density of a compactable aggregate material such as soil, gravel, or sand mixtures.

The invention of a vibratory plate compactor with aggregate feed system 10 of FIG. 1 includes a frame 12 which is supported by a sub-frame 14 which has angled soil compacting tamping plate 16 and also includes a aggregate feed system that transports aggregate from a hopper 18, through conduits in frame 12 and sub-frame 14 to the underside of a tamping plate 16 on the sub-frame 14.

Referring to FIGS. 1, 2, 5, 6 and 7, frame 12 consists of a horizontal main frame plate 20 that is rectangular in shape. Welded to the edges of the main frame plate 20 are vertical plates that extend downwardly to form a steel box that is open at the bottom. The two side plates 21 are welded to the right and left sides of the main frame plate 20, respectively. Also welded to the main frame plate 20 and side plates 21 are the forward vertical plate (not shown), rear vertical plate 24 and a transverse vertical plate 25 which is located at the center-front region of the frame 12. Extending upwards from the rearward section of the main frame plate 20 are two vertical resilient members 26 that are connected to a transverse resilient member 27 at their upper ends. The transverse resilient member 27 is connected to the top resilient member 28 which extends forward from the transverse resilient member 27 longitudinally. Pivot mount plates 30 are attached on the right and left sides to the forward end of the top resilient member 28. The lower end of the pivot mount plates 30 are connected to the forward resilient member 31 which is connected to the forward plate 23 of frame 12. A lifting eye 32 is connected to the top resilient member 28 above the center of gravity of machine 10.

Figure 2:
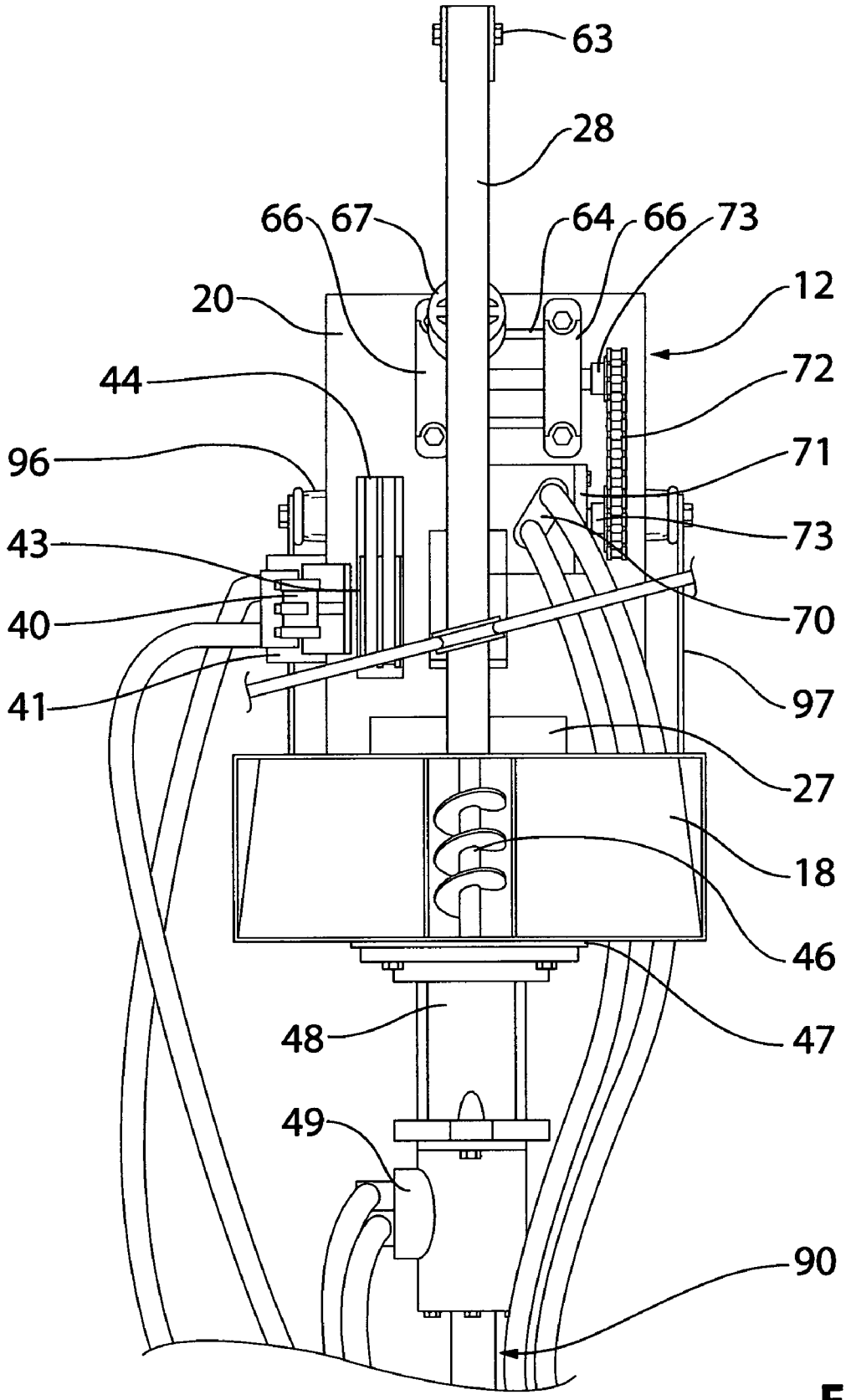
FIG. 2 is a partial top view of the present invention.
Figure 3:
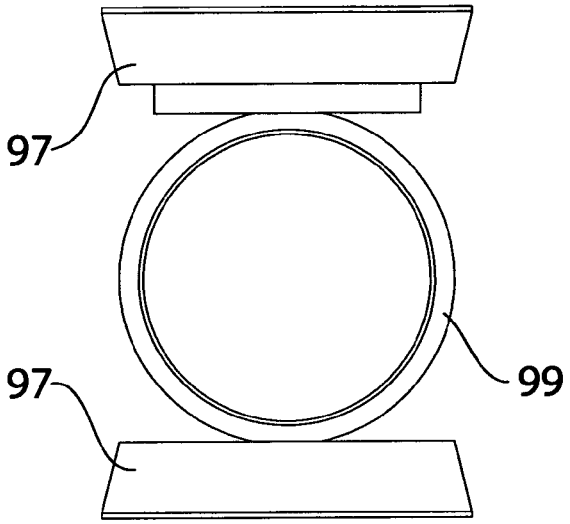
FIG. 3 is a top view of the vibration isolator.
Figure 4:
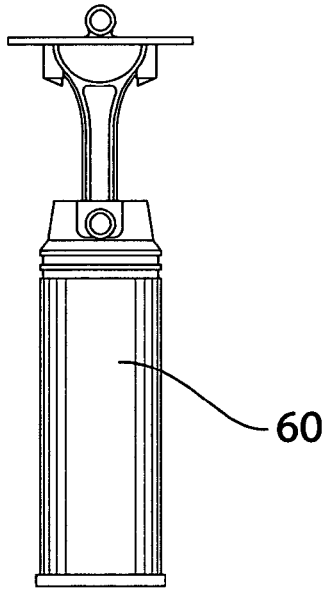
FIG. 4 is a side view of the tamping piston.
Figure 5:
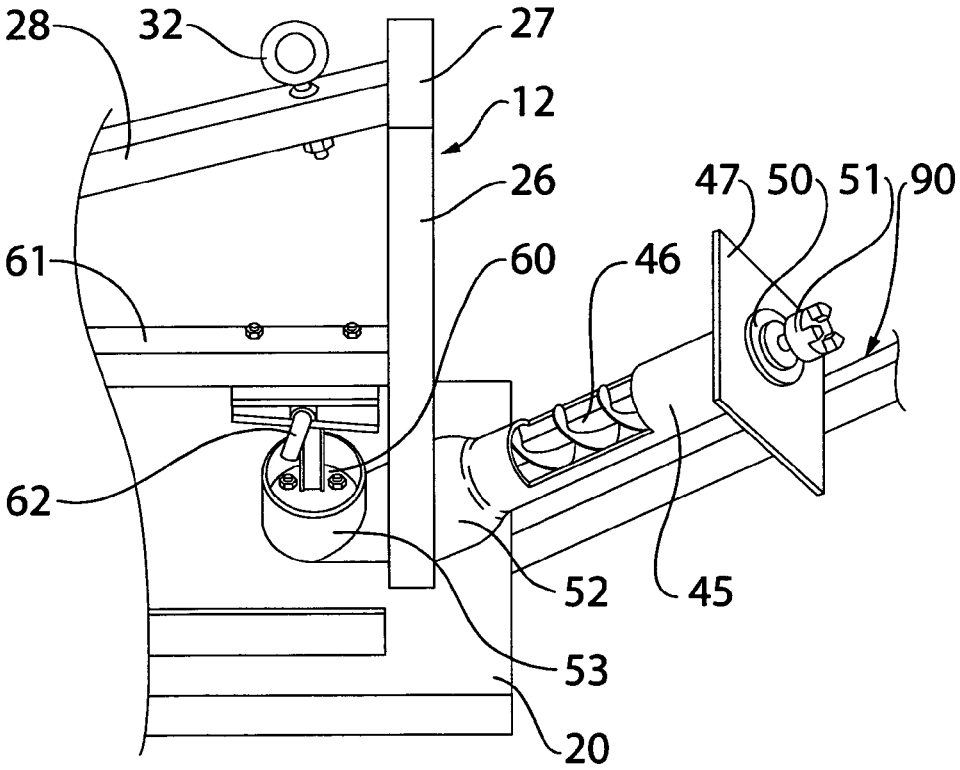
FIG. 5 is a partial downwardly angled side view of the welded frame, conduit, tamping piston and drive arm of the vibratory plate compactor with aggregate feed system with parts removed for clarity.
Figure 6:
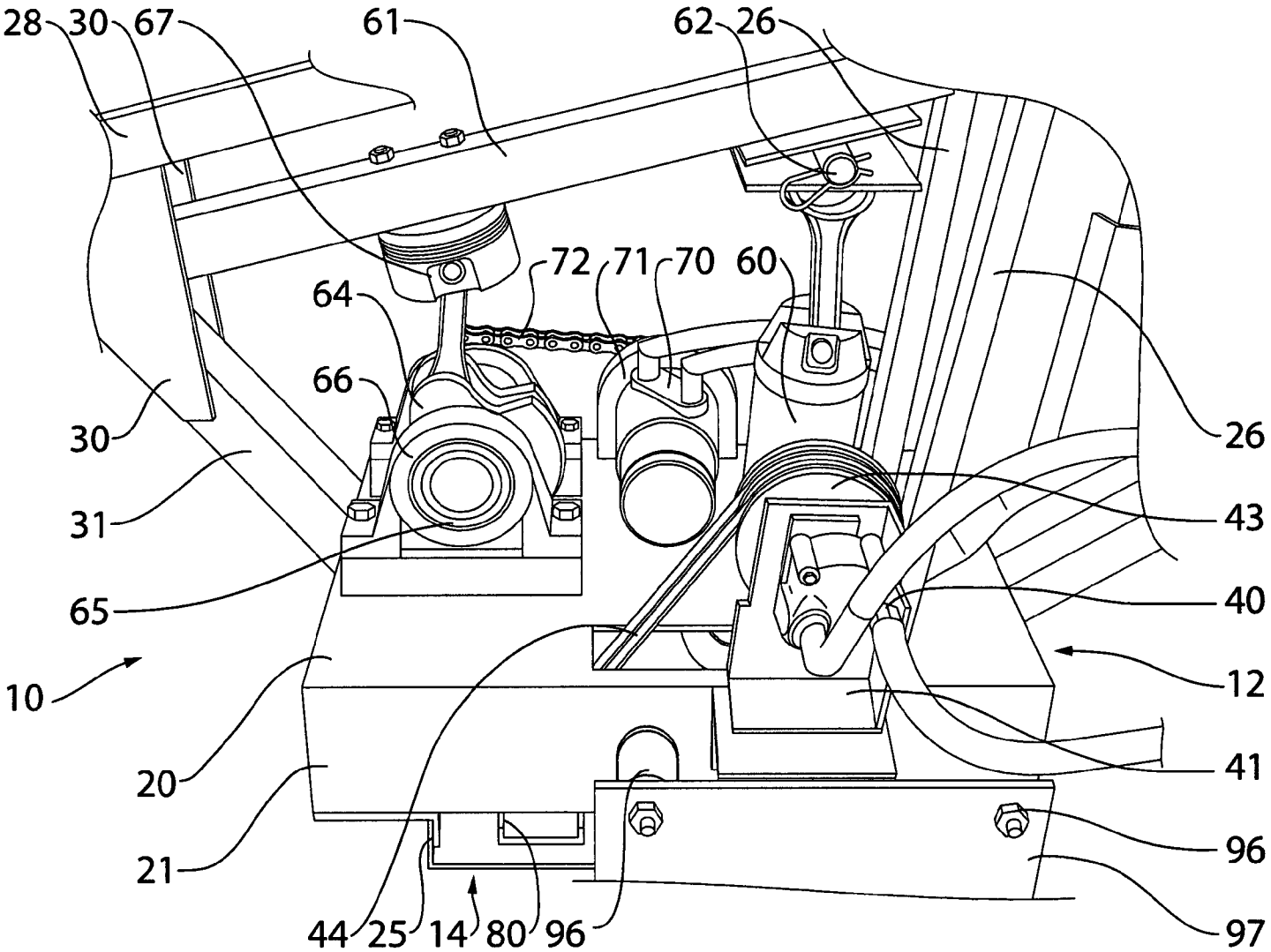
FIG. 6 is a partial downwardly angled side view of the present invention.
Figure 7:
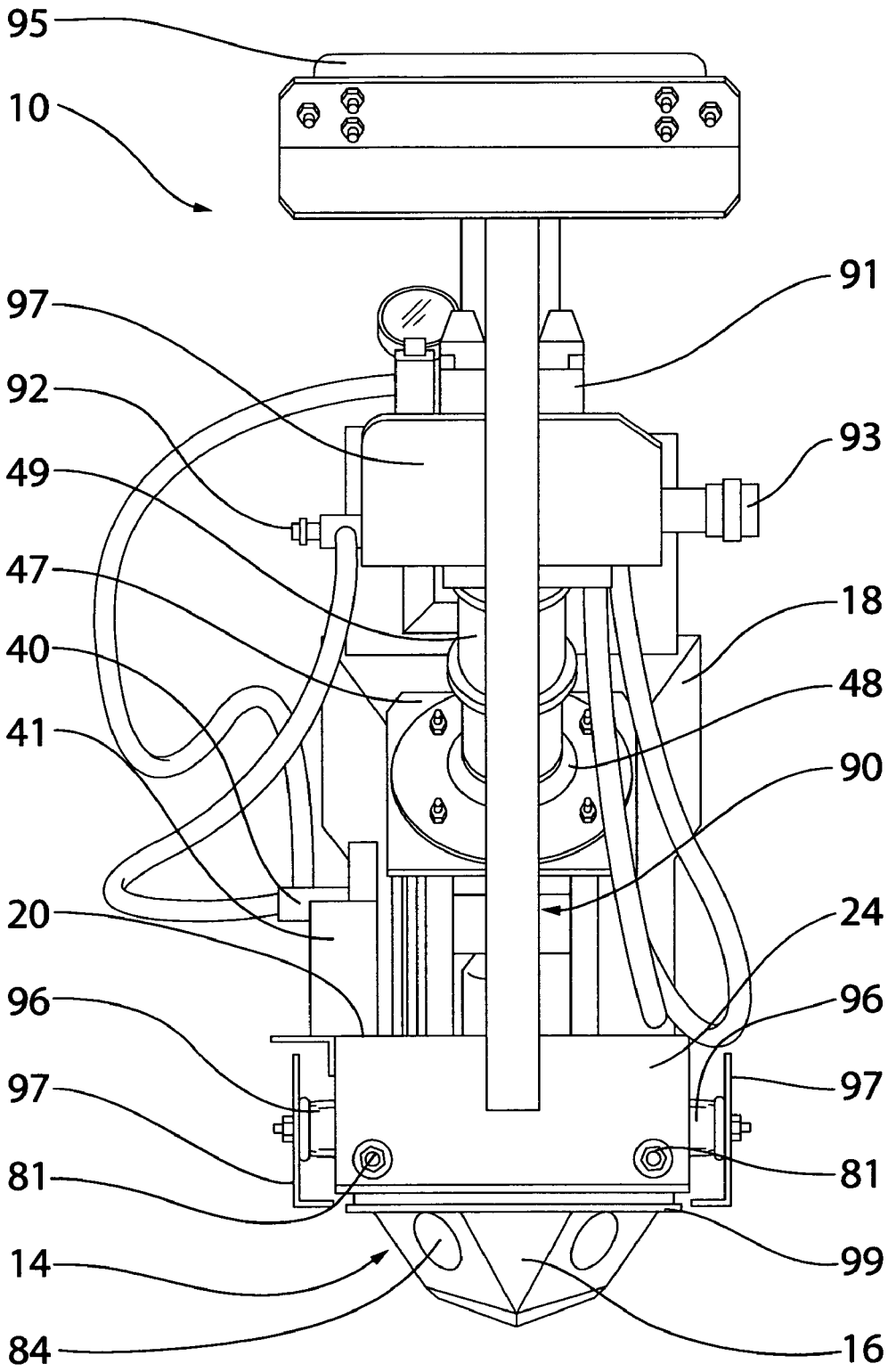
FIG. 7 is a rear view of the present invention.
Figure 8:
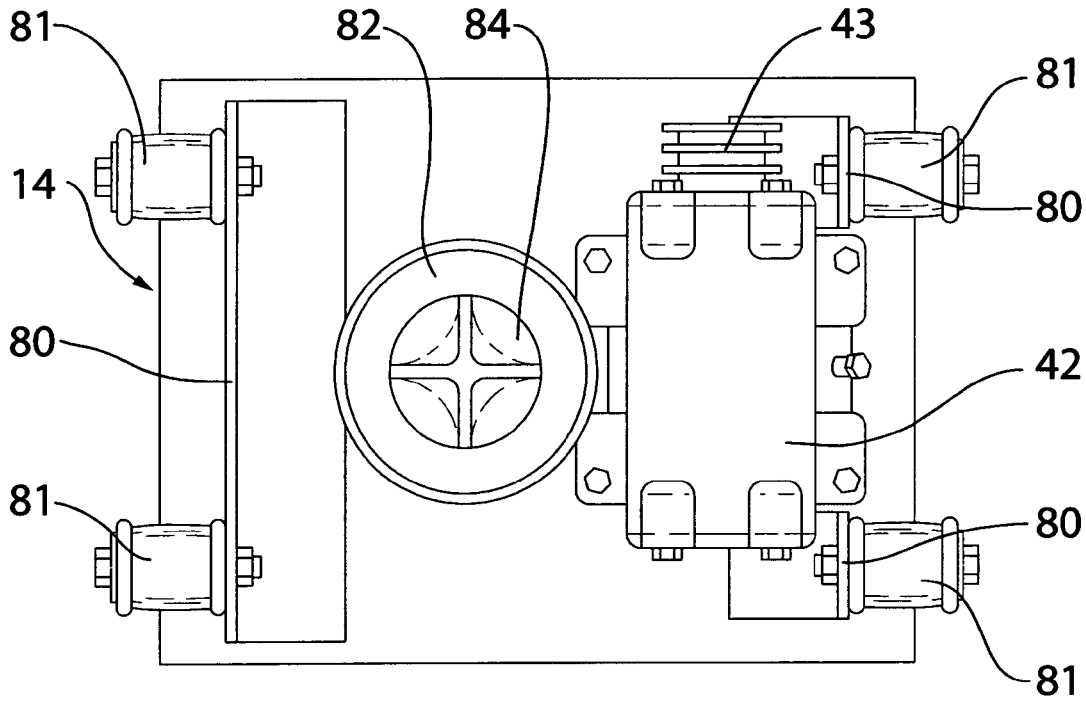
FIG. 8 is a top view of the tamping plate of the present invention.
Figure 9:
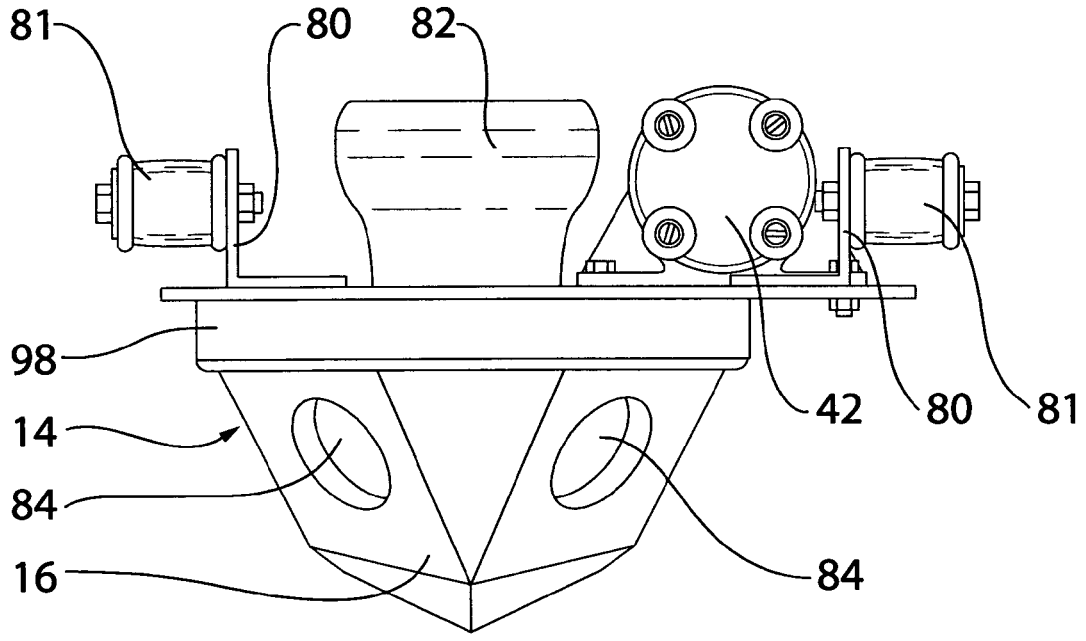
FIG. 9 is a right side view of the tamping plate of the present invention.

Referring now to FIGS. 1, 2 and 6, a drive mechanism such as a high-speed hydraulic tamping plate motor 40 with a rotatable drive shaft is mounted on a motor mounting bracket 41 which is connected to frame 12. Referring now to FIGS. 8 and 9, a vibratory actuator unit 42 consisting of an eccentrically weighted shaft is mounted for rotation on the sub-flame 14 and is connected to the output shaft or flywheel of the flame-mounted high-speed hydraulic plate tamper motor 40 by suitable flexible transmission means such as sheaves 43 and V-belts 44 or chain and sprocket means.

Referring now to FIGS. 1, 2, 5 and 7, the frame 12 carries a hopper 18 compartment for transporting and dispensing aggregate materials. An auger conduit 45, with a 75 mm diameter, is located below and open to hopper 18 and houses an auger 46 that is 73 mm in diameter. A hydraulic motor mounting plate 47 is welded to the rearward end of auger conduit 45. Attached to the hydraulic motor mounting plate 47 is a hydraulic motor mounting bracket 48 which supports the hydraulic auger motor 49. Auger bearings 50 are connected to the hydraulic motor mounting plate 47 and support the auger 46 which is coupled to the hydraulic auger motor 49 by couplings 51. The forward end of auger conduit 45 widens from 75 mm to 100 mm diameter which forms an aggregate reservoir 52 before it connects to a 100 mm diameter vertical conduit 53. The vertical conduit 53, which passes through the main frame plate 20, has apertures at its upper and lower ends and is open to the aggregate reservoir 52 at its midsection.

Referring now to FIGS. 1, 4, 5 and 6, the flame 12 also carries a 98 mm tamping piston 60, which operates in a vertical motion within the vertical conduit 53 and is connected to the tamping piston drive arm 61 by means of a pivot mount 62. The opposite end of the tamping piston drive arm 61 is connected to the pivot mount plates 30 by means of a pivot 63. A crankshaft 64 is mounted for rotation with opposite ends supported in suitably sized bearings 65 which are mounted bearing housings 66 that are bolted to the center region of the main frame plate 20. The crankshaft 64 is connected to a piston 67 which is connected to the tamping piston drive arm 61. The crankshaft 64 is driven by the hydraulic tamping piston motor 70 which is bolted to hydraulic motor foot mounting bracket 71 which is bolted to the center region of the frame 12. Tamping piston motor 70 is connected to the crankshaft 64 by suitable flexible transmission means such as sheaves and V-belts or chain 72 and sprocket 73 means.

Referring now to FIGS. 1, 8 and 9, brackets 80 on the sub-frame 14 are connected to rear vertical plate 24 and transverse vertical plate 25 of frame 12 by means of four vibration dampening rubber mounts 81. The sub-frame 14 contains a plate conduit 82 that is below and inline with the vertical conduit 53. The upper end of the plate conduit 82 has an outwardly flared aperture to receive aggregate from the vertical conduit 53. At its midsection, the plate conduit 82 divides into four smaller outlet conduits 84 which are angled outwardly. The lower end of the outlet conduits 84 have apertures in the soil compacting angled tamping plate 16.

Referring now to FIGS. 1, 2, 5 and 7, a handle 90, whereby the operator guides or steers the entire machine 10 in operation, is welded to frame 12. Hydraulic control valves 91, have quick disconnects on the inlet port 92 and outlet port 93, which connect to the hydraulic lines that lead to the hydraulic power pack (not shown). The three spool hydraulic control valves 91 are mounted on the mounting plate 94 that is welded to handle 90. The control valves 91 are within reach of the handlebar 95, which is connected to the upper rearward end of handle 90. The work ports of the hydraulic control valves 91 are connected to hydraulic hoses that are connected to each valves' corresponding hydraulic motor 40, 49, 70.

Referring now to FIGS. 1, 3, 6, and 7, four vibration dampening rubber mounts 96 are bolted to frame 12 and to two wheel rim mounting plates 97. The wheel rim mounting plates 97 are welded to a wheel rim 99. The wheel rim 99 surrounds but does not come into contact with the upper section of the tamping plate 16 or collar 98. Wheel rim 99 is sized to rest on the bead structure of the particular tire that the vibratory plate compactor with aggregate feed system 10 is operating on. The steel wheel rim 99 has been cut from a tire rim and is only the tire contacting portion of the tire rim.

In operation, the present invention is directed towards a method of filling and compacting soil aggregate in a cavity such as a used automobile tire for the purpose of using the filled tire as a building block in the construction of a tire wall. For a wall that is to be nine rows high, large tires (size R17 to R18) are used for the bottom rows of the wall, medium sized tires (size R15 to R16) are used for the middle three rows and the top rows use smaller tires (size R13 to R14).

First, an area is excavated and then a row of tires are laid down on their sides to form the foundation of the tire wall. A piece of cardboard is inserted in the bottom of each tire in order to stop aggregate from flowing out the hole in the bottom of the tire. The changeable wheel rim 99 and sub-frame 14 are sized to fit the tire the machine 10 is working on. The machine 10 is placed on the first tire with the wheel rim 99 acting as guide to line-up the tamping plate 16 with the tire by placing the wheel rim 99 directly on the bead structure of the tire. The wheel rim 99 prevents the tamping plate from coming into contact with the tire and it is mounted to the frame 12 with rubber mounts 96 which reduce the vibrational forces that could cause the sidewall of the tire to vibrate and eject aggregate from the cavity.

Aggregate is shovelled into the hopper 18 of the vibratory plate compactor with aggregate feed system 10. The control valves 91 are used to simultaneously actuate the auger motor 49 and tamping piston motor 70. The auger 46 transports aggregate material from the hopper 18, through the auger conduit 45, aggregate reservoir 52 and into the vertical conduit 26. Actuating the tamping piston motor 70 turns a crankshaft 64 by a chain 72 and sprocket 73 means. The rotating crankshaft 64 drives a piston 67 in a vertical motion, which forces the piston drive arm 61 up and down. The tamping piston drive arm 61 is connected at its forward end to the drive arm mounts 30 by means of a pivot 63 with the opposite end moving through a large arc. The moving tamping piston drive arm 64 forces tamping piston 60 to move in an up and down motion within the vertical conduit 26 and the face of the tamping piston 60 acts to compact and discharge the aggregate out of the lower aperture of the vertical conduit 26.

During the low end of the stroke of the tamping piston 60, the aperture between the aggregate reservoir 52 and the vertical conduit 26 is blocked by the sidewall of the tamping piston 60 and aggregate fills the aggregate reservoir 52. When the tamping piston 60 is at the upper end of its stroke, the aperture between the aggregate reservoir 52 and the vertical conduit 26 is not blocked by the elongated tamping piston 60 and aggregate is forced into the vertical conduit 26. During the lowest point of the stroke of the tamping piston, the soil contacting face of tamping piston 60 extends beyond the plane of the lower aperture of the vertical conduit 26 and enters the upper portion of the plate conduit 82. The tamping piston 60 forces aggregate through the plate conduit 82 and outlet conduits 84 to the underside of the tamping plate 16.

The tamping plate conduit 82 divides the flow of aggregate into the four smaller flows of the outlet conduits 84 and directs the aggregate outwards towards the inner liner of the tire. The auger motor 49 and tamping piston motor 70 are stopped and the tamping plate motor 40 is actuated. The tamping plate motor 40 drives the vibratory actuator unit 42 on the sub-frame 14 and the aggregate is further compacted beneath surface of the tamping plate 16 with a multitude of blows, which together with the mass of the assembly supported on the tamping plate in effect produces at least a ramming compacting action under the tamping plate 16 and the rapidity of the blows imparted to the material further has the effect of shaking and vibrating not only the space immediately underneath the contacted surface but also in the space adjacent laterally and in depth, tending to settle loose particles by the very shaking itself. The angled tamping plates 16 and angle of the outlet conduits 84 further increases the lateral compaction.

To ensure an even supply and compaction of aggregate, the machine operator can rotate the machine 10 by moving the handle 90 up to 30 degrees to the left or right of the operator's standing position which rotates the machine 10 while the wheel rim 99 remains in contact with the bead structure. Actuating the tamping plate motor 40 while rotating the machine 10 makes moving the machine 10 easier because the jumping action of the machine 10 when the tamping plate 16 is actuated eases the surface friction between the wheel rim 99 and the tire bead, as well as the tamping plate 16 surface and the aggregate it is in contact with. The tamping plate motor 40 is stopped and the auger motor 49 and tamping piston motor 70 are actuated while machine 10 is at an angle. The outlet conduits 84 now force compacted aggregate laterally towards the inner liner of the tire that does not yet have sufficient fill. The tamping plate motor 40 is actuated while turning the machine 10 in the opposite direction and then stopped. The auger motor 49 and tamping piston motor 70 are actuated to force aggregate laterally through the outlet conduits 84 at the remaining portion of the tire that requires additional aggregate and then stopped.

The compaction of aggregate creates a space and more aggregate is added by repeating the process of actuating the auger motor 49 and tamping piston motor 70, then the tamping plate motor 40 while turning the machine 10 to the left and right. Once the tire has been filled and the aggregate compacted to the desired density, the machine 10 may then be lifted by using a winch connected to the machine's lifting eye 32 and moved to the next tire in the row. The remaining cavity in the tire, which is the shape of the tamping plate 16, is then filled by shovelling aggregate into the space and the material is compacted with a hand tamping plate. The rows of tires are offset in a manner similar to brick wall construction and off-setting each row back towards the embankment can give greater support to the structure. The process is repeated until the tire wall is complete.

While the present invention has been described and illustrated with respect to the preferred and alternative embodiments it will be appreciated that numerous variations of these embodiments may be made without departing from the scope of the invention, which is defined in the claims.

The invention claimed is:

1. In a tamper of the type having an upper frame, a tamping plate position below the upper frame, and means for vibrating the tamping plate relative to said frame, the improvement comprising means for supplying a quantity of aggregate to be tamped to the undersurface of said tamping plate and which is characterized by an aperture which extends through said tamping plate and which said aperture has aggregate controlling means with conduit means attached to said frame and which at its end remote from said tamping plate includes hopper means for receiving said quantity of said aggregate.

2. The tamper as claimed in claim 1 wherein said conduit includes an inlet section and an outlet section, said inlet section is downwardly inclined relative to said tamping plate and said outlet section is disposed normal to said tamping plate.

3. The tamper as claimed in claim 2 wherein said inlet section includes means for restricting the flow of aggregate therethrough.

4. The tamper as claimed in claim 2 wherein said outlet section includes secondary tamping means for expelling aggregate located therein through said aperture.

5. The tamper as claimed in claim 1 wherein the vibrations of said tamping plate and said frame are isolated from the automobile tire or cavity the tamper is working on by means of a partial wheel rim connected to said frame by vibration dampening rubber mounts.

6. The tamper as claimed in claim 1 includes a steering means comprising a handle connected to said frame.

* * * * *